US005245503A

United States Patent [19]

Rodrigo

[11] Patent Number: 5,245,503

[45] Date of Patent: Sep. 14, 1993

[54] EXTENDED RANGE STATIC ELIMINATOR WITH WIDE ANGLE UNIFORM AIR FLOW

[75] Inventor: Richard D. Rodrigo, Line Lexington, Pa.

[73] Assignee: ITW, Inc., Glenview, Ill.

[21] Appl. No.: 756,789

[22] Filed: Sep. 9, 1991

[51] Int. Cl.[5] ..... H05F 3/04

[52] U.S. Cl. ..... 361/231; 454/49

[58] Field of Search ..... 361/231; 454/284, 338, 454/49, 66

[56] References Cited

U.S. PATENT DOCUMENTS 4,794,486 12/1988 Blach et al. ..... 361/231

5,012,159 4/1991 Torok et al. ..... 315/111.91

*Primary Examiner*—A. D. Pellinen

*Assistant Examiner*—Aditya Krishnan

*Attorney, Agent, or Firm*—Stanley Bilker

[57] ABSTRACT

Apparatus for conveying a stream of air in a fanned out distribution pattern over a work surface without use of diverting vanes comprises a duct having an inlet end coupled to the discharge of a tangential blower and an open outlet end for delivering a predetermined volume of air therethrough. The shape of the duct gently flares outwardly from the inlet to the outlet to provide a wider but flattened configuration in the direction of the air path although the cross-sectional areas of the inlet and outlet ends of the duct are substantially equal, whereby air exiting from the duct covers a broader yet extended range. Incorporating an A.C. static eliminator in the duct adjacent the outlet yields a uniform field of air ionization.

7 Claims, 3 Drawing Sheets

EXTENDED RANGE STATIC ELIMINATOR WITH WIDE ANGLE UNIFORM AIR FLOW

BACKGROUND OF THE INVENTION

1. Field of the Invention

This invention relates to apparatus for delivering a volume of air over a given zone, and more particularly relates to a conduit for directing air flow across high voltage A.C. discharge electrodes in order to direct a stream of ionized air over remotely positioned charged objects for the purpose of effecting neutralization thereof.

In order to determine the ability of ionized air blowers to neutralize a charge in a given location, one generally measures the conductivity of the air or the ion concentration with respect to the mobility thereof. Following recent standards developed for protection of electrostatic discharge susceptible items through ionization (EOS/ESD Standard No. 3, dated September 1987) evaluation of the efficiency of an ionizer or an ionization system is accomplished by directly measuring the rate of charge decay of articles placed in a zone extending to a predetermined depth in front of the ionizing system and transversely positioned with respect to the centerline thereof. "EOS/ESD" refers to Electrostatic Overstress/Electrostatic Discharge Association, of 200 Liberty Plaza, Rome, N.Y. 13440. According to EOS/ESD Standard No. 3, a charged plate monitor can be constructed with an insulated metal test plate having dimensions of six inches by six inches and electrically isolated from ground. The metal test plate must have a capacitance of 20 picofarads when measured with respect to ground. The charged plate monitor can be used to determine the relative ion concentration in a given location.

The EOS/ESD Standard No. 3 directs testing of table top ionized air blowers by using a test pattern where the test points are arranged in a pattern of four rows and three files in front of the ionizer to be tested. Each file is positioned three abreast from a centerline directly before the ionizer and spaced from each other by a center-to-center distance of twelve inches. A plan view of the test area is set forth in FIG. 5.

The charged plate monitor is placed sequentially at each test point. At each test point, the plate is charged to 1,000 volts, the plate being monitored by coupling to an electrometer (or by measuring the field by a non-contacting field meter). The decay time ( a measure of neutralization efficiency) is assessed by determining how long it takes the test plate to reach 100 volts at each test point.

2. Prior Art

In U.S. Pat. No. 3,844,657, a large volume of air is forced by a blower or fan through a chamber having a high efficiency particulate filter at the exit end thereof so that the air is squeezed through the particulate in laminar flow disposition. An area static eliminator is oriented about the outlet of the system to cause the positive and negative ions emitted from the discharge electrodes thereof to sweep in a laminar air flow path over a contact printing surface and cleanse the latter of charged particles. The pattern of the air flow shown by this patent is basically linear and coextensive with the width of the outlet. No vanes or other means are disclosed for diverting the laminar flow laterally so as to provide transverse expansion of the field of ionization.

U.S. Pat. No. 4,417,293 shows a nozzle in which a compressed gas is passed through an orifice having high voltage discharge electrodes adjacent the open end. After expansion through the nozzle orifice, the aerosol created entraps air ions within frozen microparticles allowing them to be discharged over a wider area for purposes of static neutralization.

In Model VSE 3000 air ionizer made by Chapman Electrostatic Systems, of Portland, Me., air is diverted laterally by wide angle diffuser vanes and then blown over discharge points to widen the field traversed by the dual polarity ions.

3. Objects of the Invention

One of the problems caused by diverter vanes is the production of back pressure as the blower or fan internally directs the air stream against the facing vane surfaces and causes turbulence in the air flow during the emergence from the ionizer. In all cases where diverter vanes are employed in various attitudes, it has been found that the charged plate monitor of EOS/ESD Standard No. 3, Ionization, exhibits disappointing results for decay times in those test point areas located laterally of the centerline.

It is therefore an object of this invention to provide an ionized air blower system in which air ions will be distributed uniformly over a widened lateral area without detracting from neutralization in a forward direction.

Another object of this invention is to provide an air distribution system, especially for extended range static eliminators, wherein turbulence in the air pattern will be minimized and the field of neutralization effective over a widened forward and transverse area.

Still another object of this invention is to provide an extended range static eliminator in which the configuration of the conduit containing the air flow is the primary source for directing the air ions over an uniform expanded path.

Other objects of this invention are to provide an improved device of the character described which is easily and economically produced, sturdy in construction and highly efficient and effective in operation.

SUMMARY OF THE INVENTION

In accordance with the present invention, there is provided a conduit apparatus for delivering a stream of ionized air in a uniform fanned-out shape without the use of vanes or deflectors. The apparatus includes a tangential blower having a discharge volute which is coupled to the inlet end of a duct whose outlet has a cross-sectional area substantially equal to that of the inlet. The duct itself is of a configuration which gently flares outwardly in a widthwise sense but is flattened in a vertical direction. As the air enters the duct, the forward motion is constricted through the narrowing channel provided by the vertically converging surfaces but is not squeezed by the widening surfaces. As a consequence, the air flow is caused to assume a velocity component in the horizontal direction perpendicular to the forward motion. At the centerline, the transverse horizontal velocity is zero, and the direction of the air flow is longitudinally through the duct. At the edges where the duct is becoming wider, the transverse horizontal velocity is the greatest whereby the air flow divergence is at maximum. Intermediate the longitudinal centerline and the lateral edges, the transverse horizontal velocity uniformly tapers down from maximum to zero with minimal turbulence in the emergent pattern. When an ion stream is introduced into the air flow by action of the static eliminator discharge electrodes, the fanned-out ion field is also uniformly distributed. Since there are no vanes, there is less surface area exposed to the air flow. As a consequence, less back pressure is produced, thus allowing a larger air flow volume for a given air mover.

BRIEF DESCRIPTION OF THE DRAWINGS

With the above and related objects in view, this invention consists of the details of construction and combination of parts as will be more fully understood from the following detailed description when read in conjunction with the accompanying in which.

DETAILED DESCRIPTION

Figure 1:
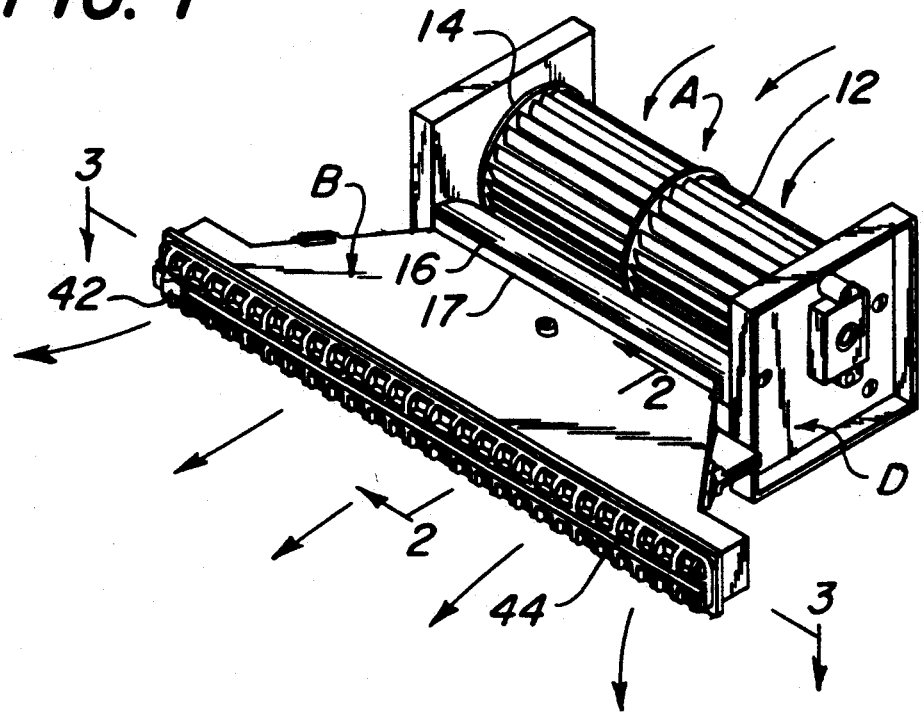
FIG. 1 is a perspective view of an ionized air blower embodying this invention.

Referring now in greater detail to the drawing in which similar reference characters refer to similar parts, I show an apparatus for directing a stream of ionized air in a gently fanned-out distribution pattern comprising a blower, generally designated as A, a conduit duct, generally designated as B, and ionizing electrodes C for creating dual polarity air ions, all enclosed within a suitable housing D.

As best illustrated in FIG. 1, the blower A is a conventional tangential type rotary blower, such as Fasco Model 7002-0494, wherein a plurality of blades 12 rotating at a speed of about 2300 to 3200 RPM within a spiral casing is adapted to expel approximately 100 to 120 CFM of air through a discharge volute 16. The discharge end 16 of the blower A is generally rectangular in configuration with an opening 7-½" by 1-⅛" to provide a cross-sectional area of 8.44 square inches, and this discharge end 16 is coupled directly to the conduit duct B by suitable flanges 17.

Figure 4:
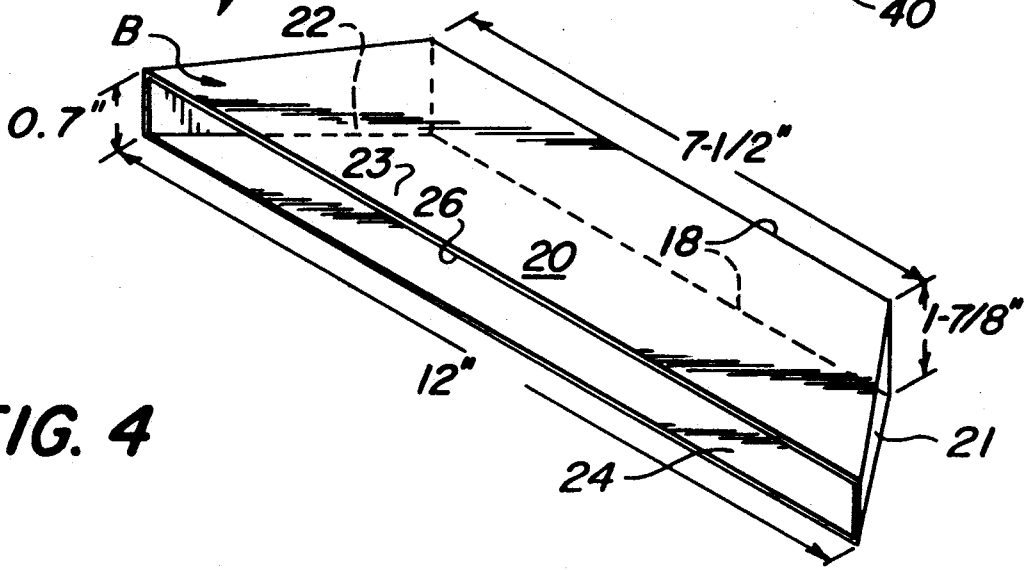
FIG. 4 is a perspective view of the duct conduit embodied in the present invention.

The conduit duct B is molded of a suitable insulative plastic material, such as high density polyethylene, and has a rectangular inlet 18 which is dimensionally complementary with the discharge port 16 of blower A-i.e. 7½" by 1⅛", namely 8.44 square inches. As best shown in FIG. 4, the duct B has a body portion 20 with lateral flat walls 21 and 22 which flare outwardly toward its distal end but whose flat top and bottom walls 23 and 24 converge toward each other to define a rectangular 12" by 0.70" outlet 26 substantially equal in cross-sectional area (8.40 square inches) to the 8.44 square inch cross-sectional area of the inlet end 18. The length of the duct from the inlet to the outlet is about 3 inches, such dimensional ratios being somewhat critical.

Figure 2:
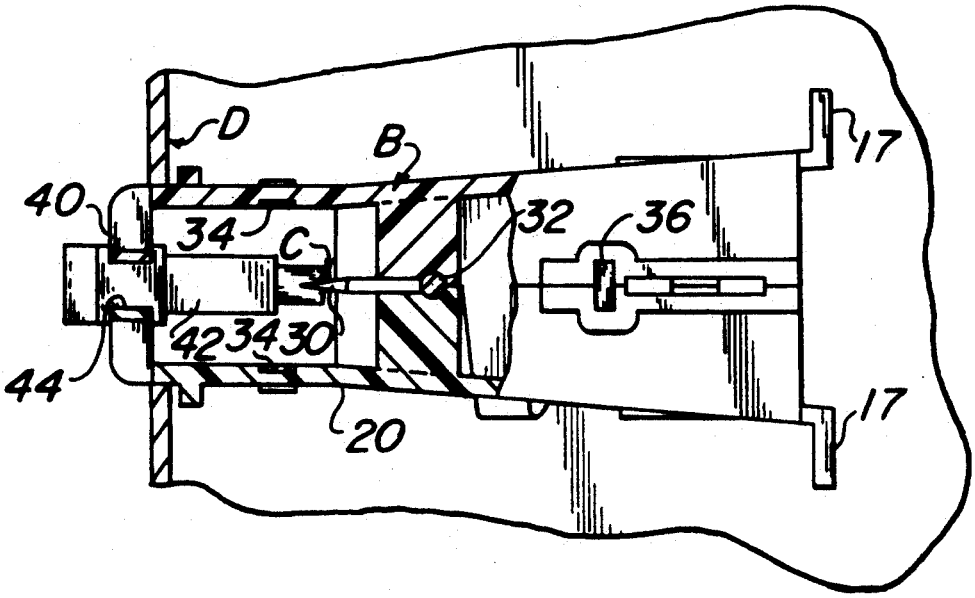
FIG. 2 is a sectional view taken along lines 2—2 of FIG. 1.
Figure 3:
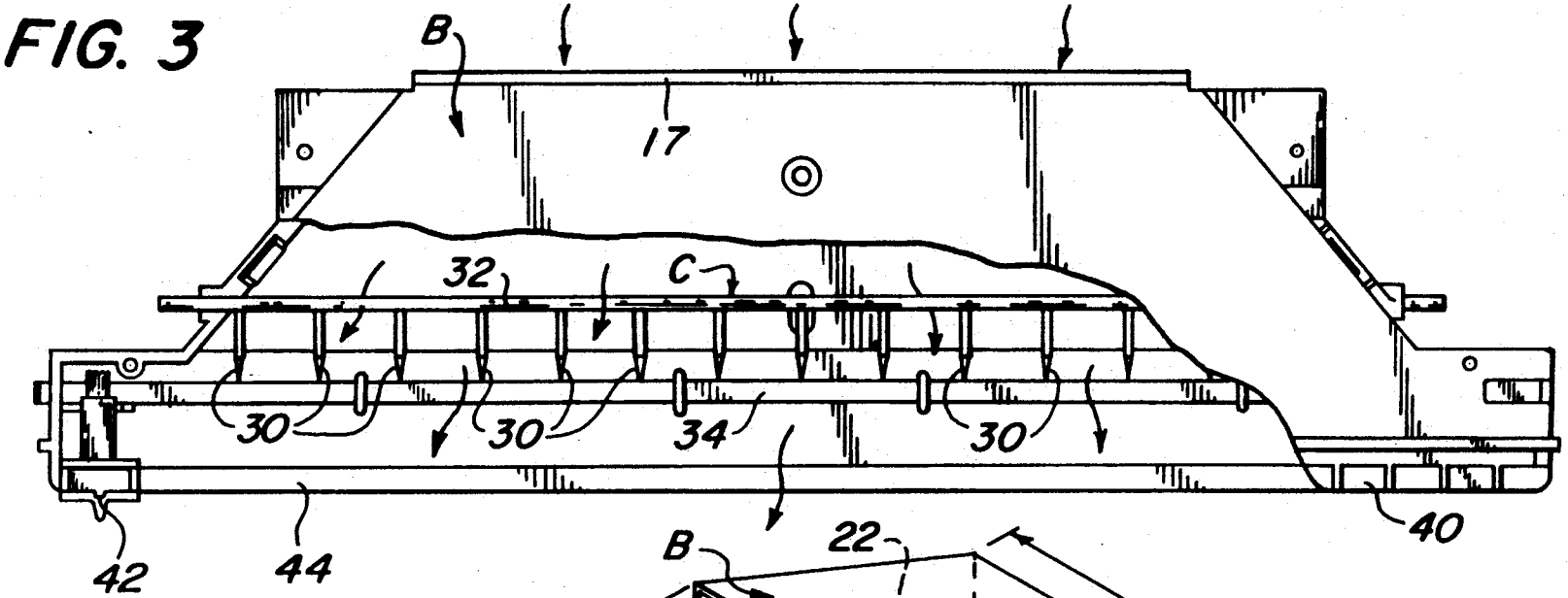
FIG. 3 is a frontal top perspective view thereof, and partly broken away to reveal the discharge electrode position.

Referring now to FIGS. 2 and 3, the discharge electrodes C constitute a conventional electrical static eliminator, such as shown in U.S. Pat. No. 4,188,530, wherein air is blown across a series of points 30 mounted on a static bar 32 laterally positioned across the interior of the duct B so that the points face the outlet 26 thereof. A grounded reference electrode 34 is adjacently spaced with respect to the points 30. When a high voltage A.C. power supply (not shown) is connected across the discharge points 30 and the reference electrode 34, positive and negative ions are caused to be emitted in the air gap therebetween. Suitable apertures 36 are provided in the duct B to enable electrical facilities to be connected from the exterior to internal heaters for warming the air.

An insulative plastic grille 40 is incorporated over the outlet end 26 of the duct B in order to prevent accidental finger contact by operating personnel with the high voltage discharge electrodes C. While not an integral part of the instant invention, a traversing brush 42 is slidably disposed in a slot 44 in the grille 40 so that the brush bristles are adapted to wipe across the discharge points 30 in order to clean them of dust and/or contamination.

Figure 5:
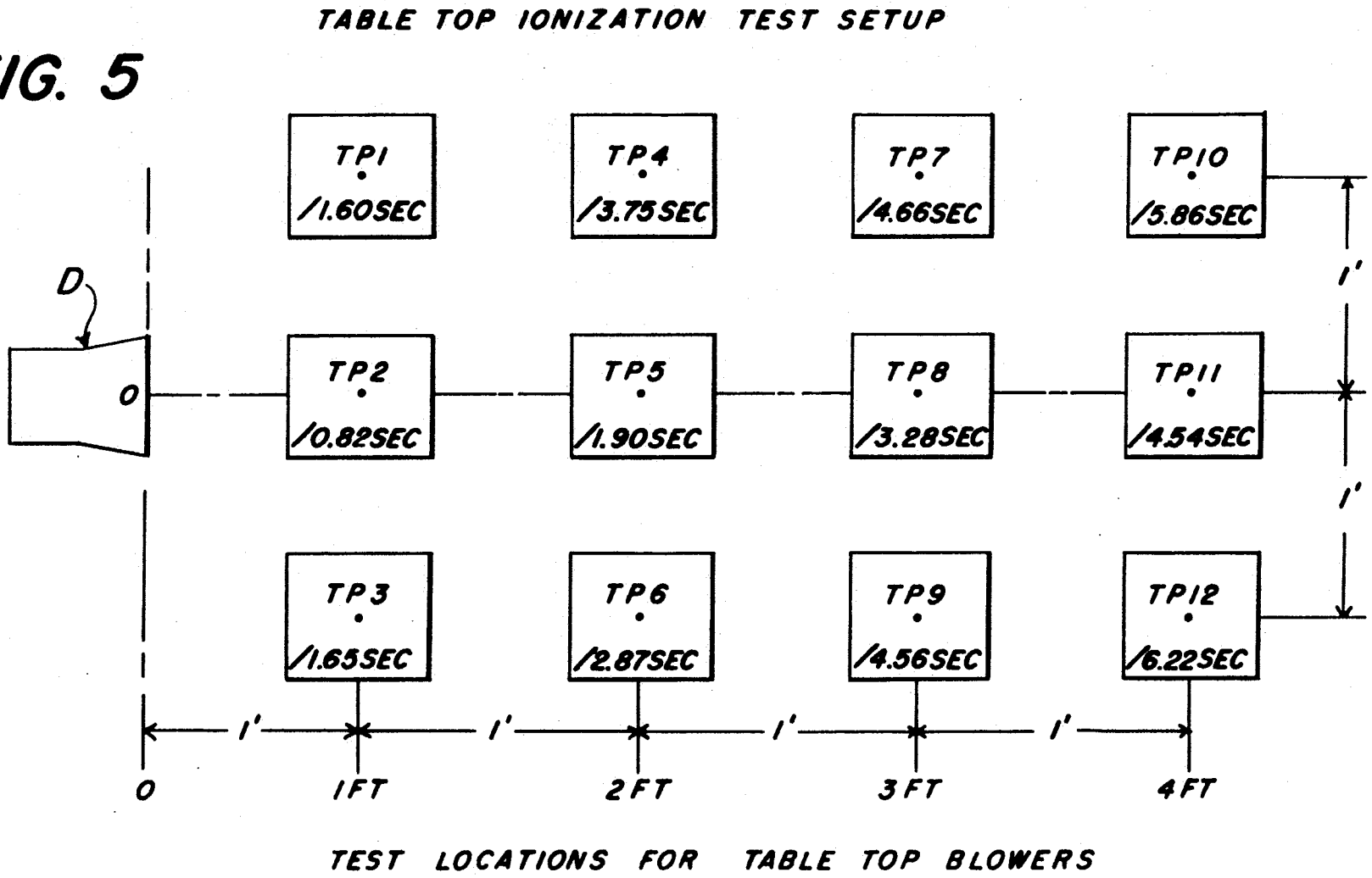
FIG. 5 is a diagrammatic view illustrating the test point locations for evaluating ionization efficiency in accordance with EOS/ESD Standard No. 3, Ionization.

In FIG. 5 is shown the table top ionization test set up according to EOS/ESD Standard No. 3. With the ionizing air blower located at position 0, a first row of test points TP1, TP2 and TP3 is set exactly 1'0" from position 0 (i.e.—the terminus of the conduit duct B), a second row of test points TP4, TP5 and TP6 is set precisely 2'0" from position 0, a third row of test points TP7, TP8 and TP9 is placed 3'0" from position 0, and a fourth row of test points TP10, TP11 and TP12 is set at 4'0" from position 0. The center file of test points, TP2, TP5, TP8 and TP11, is positioned along the centerline projection of the air ionizer at position 0 while file TP1, TP4, TP7 and TP10 are placed 1'0" to the right of said centerline and file TP3, TP6, TP9 and TP12 to the left of said centerline.

A charged plate monitor is described by EOS/ESD Standard No. 3 as an insulated metal plate six inches by six inches with a total capacitance of approximately 20 picofarads to ground. The voltage on the metal plate is monitored by a contact electrometer (or by a non-contacting field meter). The charged plate monitor is adapted to charge the plate to 1,000 volts, for example. After the charged test plate has been exposed to the ionized air stream, the time it takes for the plate voltage to drop at the test point from its initial value of 1,000 volts to 100 volts is recorded by an electronic clock, such decay times being taken as a measure of neutralization efficiency of the table top neutralization apparatus.

Decay time results on the foregoing air ionizer using a duct having the same inlet and outlet area were as follows:

| Plate Position | Ave. Decay Time - secs (1,000 v to 100 v) |
|---|---|
| TP1 | 1.60 |
| TP2 | 0.82 |
| TP3 | 1.65 |
| TP4 | 3.75 |
| TP5 | 1.90 |
| TP6 | 2.87 |
| TP7 | 4.66 |
| TP8 | 3.28 |
| TP9 | 4.56 |
| TP10 | 5.86 |
| TP11 | 4.54 |
| TP12 | 6.22 |
| Overall Average | 3.48 |

Where the ratio of the inlet to outlet area of the duct is reduced to 2:1 (i.e.—7.5"×1.125"=8.44 sq. in. inlet versus 12"×0.35"=4.2 sq. in. outlet), air flow through the duct is restricted to the extent that considerable back pressure is produced with consequent increase in turbulence and reduction in uniformity of the ionization field patterns.

Where the ratio of the inlet to outlet areas of the duct is increased to approximately 1:1.5 (i.e. 7.5"×1.125"=8.44 sq. in. inlet versus 12"×1.125"=13.5 sq. in., a slight indraft is produced at the exit corners so as to diminish the lateral breadth of the ionized air field.

Tests on ionized air blowers employing diverter vanes adjacent the exit end of the conduit duct to distribute the air flow laterally indicates that considerable back pressure occurs which augments turbulence and sacrifices performance, especially in those regions where the air velocity is low.

As is apparent from the foregoing description, the use of a conduit duct having an inlet to outlet area ratio of 1:1 through which an air stream is forced by a tangential blower in combination with an electrical static neutralizer enables a fan-shaped air flow distribution that is uniform in velocity and one in which a wide angle distribution of ions is produced over an extended range.

Although this invention has been described in considerable detail, such description is intended as being illustrative rather than limiting, since the invention may be variously embodied without departing from the spirit thereof, and the scope of the invention is to be determined as claimed.

What is claimed is:

1. Apparatus for directing a stream of ionized air in a fanned-out distribution pattern over a work surface comprising:

a duct having an inlet end and an outlet end, means for blowing a stream of air through the inlet end of said duct for discharge through said outlet, the inlet end of said duct being coupled with said means for blowing and having a predetermined cross-sectional area, and electrostatic ionizing means in said duct for emitting A.C. bipolar ions into the stream of air being blown therethrough, said duct having opposed flat lateral walls which flare outwardly from the inlet end thereof toward the outlet end and including opposed flat upper and lower walls which converge from the inlet end thereof toward the outlet end, the outlet end of said duct having a cross-sectional area substantially the same as that of the inlet end thereof to produce an exiting air distribution pattern which diverges uniformly at the outlet end in a horizontal direction from the centerline of the air flow path to the outwardly flared lateral walls whereby the emergent air stream will be expelled in an extended range wide angle distribution pattern without turbulence.

2. The apparatus of claim 1 wherein electrostatic ionizing means are adjacent the outlet end thereof.

3. The apparatus of claim 1 wherein said means for blowing a stream of air through said duct comprises a tangential blower.

4. The apparatus of claim 2 wherein said electrostatic ionizing means comprise a plurality of pointed electrodes facing the outlet end of said duct, a grounded reference electrode adjacently spaced from the pointed electrodes, and means for coupling a high voltage A.C. power supply across said pointed electrodes and said reference electrode.

5. Apparatus for directing a stream of ionized air in a fanned-out distribution pattern over a work surface comprising:

(a) a blower having a discharge end for tangentially delivering a predetermined volume of air therefrom, (b) a duct having an inlet end coupled to the discharge end of the blower and an outlet end through which air is expelled, and (c) means constituting an A.C. static eliminator supported within said duct for emitting dual polarity ions into the air stream passing through the duct, the inlet end of said duct being substantially complementary with the discharge end of said blower and having a predetermined cross-sectional area, the cross-sectional area of the inlet end and the outlet end of the duct being substantially equal, and the duct having a configuration flaring outwardly from the inlet end to a flattened wider outlet end including diverging flat lateral walls and opposing flat upper and lower converging walls to produce an exiting air distribution pattern which diverges uniformly at the outlet end from the centerline of the air flow path in a horizontal direction to the outwardly flared walls air flow whereby the emergent ionized air stream will be uniform and non-turbulent.

6. The apparatus of claim 5 including a protective grille over the outlet end of said duct to prevent operating personnel from accidentally contacting said static eliminator means.

7. Apparatus for directing a stream of ionized air in a fanned-out distribution pattern over a work surface comprising:

a duct having an inlet end and an outlet end, means for blowing a stream of air through the inlet end of said duct for discharge through said outlet, the inlet end of said duct being coupled with said means for blowing and having a predetermined cross-sectional area, and means in said duct for emitting A.C. bipolar ions into the stream of air being blown therethrough, said duct having opposed flat lateral walls which flare outwardly from the inlet end thereof toward the outlet end and including opposed flat upper and lower walls which converge from the inlet end thereof toward the outlet end, the outlet end of said duct having a cross-sectional area substantially identical to the inlet end thereof to produce an exiting air distribution pattern whose air velocity vectors are substantially equal in magnitude in both vertical and horizontal directions and in the absence of diverter vanes diverge uniformly in a horizontal direction along the air flow path at the outlet end whereby the emergent air stream will be expelled uniformly in an extended-range wide-angle distribution pattern without turbulence.

* * * * *